US011078717B2

(12) United States Patent
Vitello et al.

(10) Patent No.: US 11,078,717 B2
(45) Date of Patent: Aug. 3, 2021

(54) GARAGE DOOR WINDOW

(71) Applicants: James A. Vitello, Escondido, CA (US); Steven Kennedy, Escondido, CA (US)

(72) Inventors: James A. Vitello, Escondido, CA (US); Steven Kennedy, Escondido, CA (US)

( * ) Notice: Subject to any disclaimer, the term of this patent is extended or adjusted under 35 U.S.C. 154(b) by 0 days.

(21) Appl. No.: 16/874,076

(22) Filed: May 14, 2020

(65) Prior Publication Data

US 2020/0392780 A1 Dec. 17, 2020

Related U.S. Application Data

(63) Continuation-in-part of application No. 16/441,860, filed on Jun. 14, 2019, now abandoned.

(51) Int. Cl.

| | |
|---|---|
| ***E06B 3/26*** | (2006.01) |
| ***E06B 3/46*** | (2006.01) |
| ***E05B 65/08*** | (2006.01) |
| ***E06B 3/48*** | (2006.01) |
| ***E06B 7/14*** | (2006.01) |
| ***E06B 7/30*** | (2006.01) |
| *E06B 9/52* | (2006.01) |

(52) U.S. Cl.

CPC ..... *E06B 3/4618* (2013.01); *E05B 65/0888* (2013.01); *E06B 3/26* (2013.01); *E06B 3/485* (2013.01); *E06B 7/14* (2013.01); *E06B 7/30* (2013.01); *E05Y 2900/106* (2013.01); *E06B 9/52* (2013.01); *E06B 2009/527* (2013.01)

(58) Field of Classification Search

CPC ..... E06B 3/4618; E06B 3/485; E06B 3/26; E06B 7/14; E06B 2009/527; E06B 9/52; E06B 7/30; E06B 7/02; E06B 3/5892; E06B 3/62; E06B 2003/7044; E05B 65/0888; E05Y 2900/106

USPC ..... 52/204.5, 204.53, 204.54, 204.597, 52/204.71, 204.72, 204.1, 206, 212, 215, 52/578, 582.1, 586.1, 585.1, 590.2, 656.2

See application file for complete search history.

(56) References Cited

U.S. PATENT DOCUMENTS

| | | | | | |
|---|---|---|---|---|---|
| 3,899,258 | A * | 8/1975 | Matthews | E06B 3/9682 | 403/292 |
| 4,164,105 | A * | 8/1979 | Herbst | E06B 3/28 | 160/394 |
| 5,218,799 | A * | 6/1993 | Appino | E06B 1/18 | 52/204.53 |
| 5,233,802 | A * | 8/1993 | Rogers | E06B 1/20 | 49/505 |
| 5,644,881 | A * | 7/1997 | Neilly | E06B 3/5892 | 49/505 |
| 5,765,325 | A * | 6/1998 | DeBlock | E06B 3/5892 | 52/171.1 |
| 5,894,706 | A * | 4/1999 | Herbst | E06B 3/22 | 52/782.1 |

(Continued)

*Primary Examiner* — Brent W Herring
(74) *Attorney, Agent, or Firm* — Eric Hanscom

(57) ABSTRACT

This invention is directed toward an adjustable window for a garage door panel, where the window has an interior frame and an exterior frame. Both the interior and exterior frame have straight members that are secured to each other through the parts of the garage door that surround the opening with screws and screw receptacles. Connecting the frame members are adjustable corner braces that come in a variety of designs, with some being invisible after installation and others forming a decorative "corner" to the window.

19 Claims, 16 Drawing Sheets

(56) References Cited

U.S. PATENT DOCUMENTS

| | | | | |
|---|---|---|---|---|
| 6,513,288 | B1 * | 2/2003 | MacDonald | E04B 2/7435 160/137 |
| 6,715,245 | B2 * | 4/2004 | Lewkowitz | E06B 3/5892 52/204.53 |
| 7,954,285 | B2 * | 6/2011 | Taylor | E06B 3/5892 52/208 |
| 8,028,489 | B1 * | 10/2011 | Lawrence | E06B 3/9641 52/656.7 |
| 8,733,041 | B2 * | 5/2014 | Phipps | E06B 7/30 52/204.591 |
| 8,851,787 | B2 * | 10/2014 | Kelley | B29C 66/72523 403/402 |
| 8,966,839 | B2 * | 3/2015 | Rebman | E06B 3/263 52/203 |
| 9,022,091 | B2 * | 5/2015 | Shives | E06B 3/5892 160/201 |
| 9,567,795 | B2 * | 2/2017 | Ou | E06B 3/9682 |
| 2003/0188498 | A1 * | 10/2003 | Lewkowitz | E06B 5/12 52/208 |
| 2006/0005481 | A1 * | 1/2006 | Ouellette | E06B 3/5892 52/204.1 |
| 2009/0241422 | A1 * | 10/2009 | Mock | E06B 5/10 49/197 |
| 2014/0262072 | A1 * | 9/2014 | Shives | E06B 3/9682 160/201 |
| 2015/0020472 | A1 * | 1/2015 | Kelley | B29C 66/52431 52/656.9 |
| 2019/0257138 | A1 * | 8/2019 | Vitello | E06B 9/54 |

* cited by examiner

GARAGE DOOR WINDOW

CROSS REFERENCE TO RELATED APPLICATIONS

This application is a continuation-in-part from U.S. Utility patent application Ser. No. 16/441,860 entitled Garage Door Window, filed 14 Jun. 2019, which in turn, was a continuation-in-part of U.S. application Ser. No. 16/274,001, entitled Garage Door Window, filed 12 Feb. 2019, the contents of which are incorporated by reference.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of garage doors, and more specifically to a window designed for a panel of a garage door.

History of the Invention

Garage doors have been in existence for since Roman times, but as pertaining to the automobile industry began in the early 1900's, beginning as monolithic, single panel garage doors. Over the past several decades, sectional garage doors have become more and more popular as they can be "rolled" up in sections, thereby not requiring any "swing distance" away from the garage to swing as they are pulled up. A second advantage of sectional, or panel, garage doors is that each section or panel has a connection to track upon which it slides, thereby giving the door a more secure means of attachment to the garage door than would a traditional, monolithic garage door, which is usually connected to the garage door through two springs.

An ongoing problem with garage doors is that the common materials from which they are made—namely metal, plastic and wood—do not tend to "breath" well. Garages are notorious for storing a wide variety of smelly and toxic articles, ranging from the gasoline-powered engines of automobiles and lawnmowers to paint and other chemicals. While some monolithic garage doors had glass windows built into them that could be opened, the same technology has not made its way in a significant manner to the panel construction industry.

In addition to using their garages to store automobiles, yard equipment and the like, many homeowners use their garages as a temporary home for pets. Since the pets often have to share the garage with the aforementioned smelly and toxic items, it would be advantageous to improve the air circulation in a garage. While it would be relatively easy to build in some opening windows into a monolithic garage door, it is more difficult trying to fit an efficient "vent" into a single panel.

Even if a venting panel were to be successfully integrated into a panel, no pet owner would want his or her pet to escape from the garage through the vent—hence, there would need to be means of allowing air, but not the pet, to escape the garage. Thus, has been created a long-felt need for a window that can be installed—either during the construction or as a retrofit—into a panel that allows for both air ventilation and pet confinement.

It is commonly known that there are many garage door manufacturers that manufacture several different garage door styles. Many of styles, from the various manufactures, have different window, or vent, opening dimensions. Typically, each garage door manufacturer has premade window, or vent, frames that are four sided and rigid in nature and produced to fit only the window, or vent, opening that is cut into the garage door panels and that fits that particular size. These variations in the window, or vent, design dimensions create the need for dozens of different window frame dimensions requiring dozens of different plastic injection molds, requiring a huge expense, and making it difficult to create a standardized window frame size. In today's market there are over one hundred different sizes of garage door windows collectively from all current garage door manufactures. All requiring a specific size window and frame to be produced.

The current invention provides just such a solution by having a customized, adjustable frame and brace assembly, providing a solution for these needs by creating a method allowing varied and numerous window, or vent, design dimensions to be outfitted with this one design product. When inserted, into a precut garage window opening, it can be expanded or reduced in size to fit that particular size window opening. In addition, this concept has an added feature of a screen assembly that most garage windows, currently on the market, do not provide. Thus, it can also be manually opened and closed to allow free flowing air and ventilation into the otherwise confined spaces of a garage. In turn, because this one adjustable design concept can be manufactured from a limited number of plastic injection molds, and parts, the savings on production costs, that would otherwise be needed to manufacture all the other various sized frames, would be substantial.

This invention would not only permit garage door manufacturers to reduce costs, inventory controls, and have an additional screen equipped window option available to their consumers but would also be available for the aftermarket homeowners, that already have a garage door with traditional non-opening windows, to purchase this one adjustable size design to easily retrofit their current window, regardless of size, with newly installed screened windows. They may also be used in place of any standard garage door frame that is customarily of a fixed and rigid design if the manufacturer of the garage door should choose to use this design instead.

Objects of the Invention

It is therefore an object of the present invention to provide a window that can be built into a garage door.

An additional object of the invention includes providing a window that can be installed into an existing garage door.

Another object of the invention is to provide a sliding mechanism by which the garage door window can be opened and closed easily.

A further object of the invention is to provide bars on the window to prevent pets from escaping through the garage door window.

Another object of the invention is to provide an easily-installed garage door window.

A final object of the invention is to provide for multiple windows to be inserted into a single panel of a garage door.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

It should be understood the while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

BRIEF DESCRIPTION OF THE FIGURES

One preferred form of the invention will now be described with reference to the accompanying drawings. It is noted that the following figures are not drawn to scale.

DETAILED DESCRIPTION OF THE FIGURES

Figure 1:
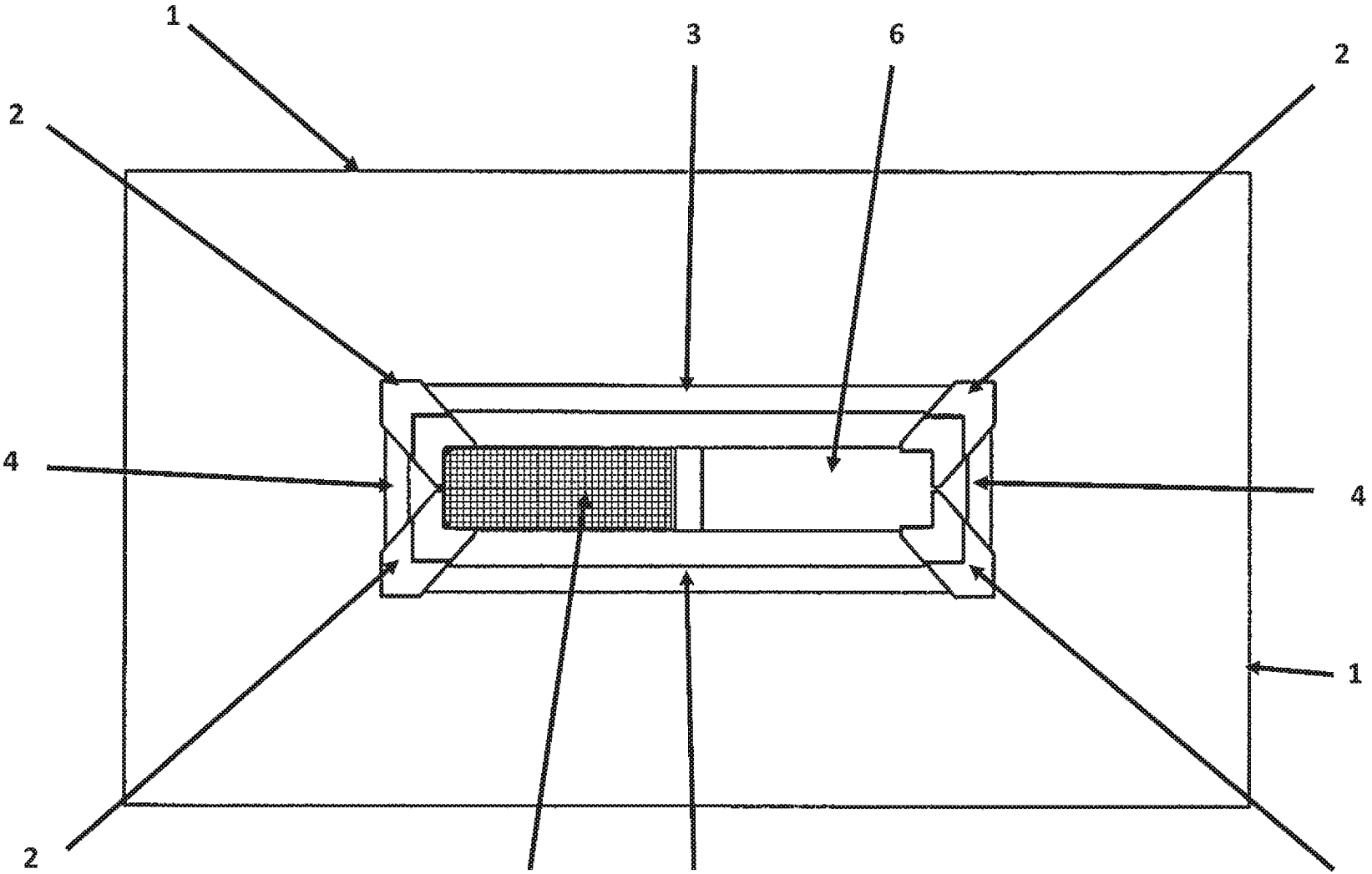
FIG. 1 is a front (exterior) view of a garage door panel with the invention-design inserted.

Many aspects of the invention can be better understood with references made to the drawings below. The components in the drawings are not necessarily drawn to scale. Instead, emphasis is placed upon clearly illustrating the components of the present invention. Moreover, like reference numerals designate corresponding parts through the several views in the drawings. Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

It is commonly known that there are many garage door manufacturers that manufacture several different garage door styles. Many of styles, from the various manufactures, have different window, or vent, opening dimensions. Typically each garage door manufacturer has premade window, or vent, frames that are four sided and rigid in nature and produced to fit only the window, or vent, opening that is cut into the garage door panels and that fits that particular size. These variations in the window, or vent, design dimensions create the need for dozens of different window frame dimensions requiring dozens of different plastic injection molds, requiring a huge expense, and making it difficult to create a standardized window frame size.

This concept, of a customized frame and brace assembly, is designed to create a method allowing various window, or vent, design dimensions to be produced from a limited number of plastic injection molds.

It is noted that for proper instillation each garage window, or vent, design requires two types of frames. First is an exterior frame which is placed on the exterior side of a garage door panel and is typically visible when viewing the exterior of the home, or building. It is usually more ornate than the interior frame. The second frame would be the interior frame placed on the interior side of the of the garage door panel. The exterior and interior frames would be of different construction styles. They would be placed adjacent to one another and secured together, against the garage door panel, using a securing device such as screws, nut and bolts, glue, tape, or by other means. In most current garage window, or vent, designs the frame consists of four sides, similar to a picture frame.

It is noted that the following figures are not drawn to scale.

FIG. 1 is a front view of a garage door panel with the invention-design inserted. It shows the relationship of all the exterior parts in regard to each other. The garage door panel 1 is a standard garage door panel that can be found in any sectional garage door. A hole is moulded or cut into the panel, and the invention fits into this hole. The invention is bounded by various trims that are covered with corner braces. Here, there are Horizontal Exterior Frame Trim and Vertical Exterior Frame Trim, the ends of which are covered by Exterior Corner Braces. This unique arrangement allows for the invention to expand and contract, depending on the size of the hole, and yet have the ends of the Horizontal 3 and Vertical 4 Exterior Frame Trim covered in an attractive (and functional) manner. Inside the area bounded by the Exterior Corner Braces and Horizontal Exterior Frame Trim sits a Screen Insert and a solid Clear Insert 6. The Screen Insert is what allows for ventilation, and the Clear Insert allows for light to penetrate the garage.

Figure 2:
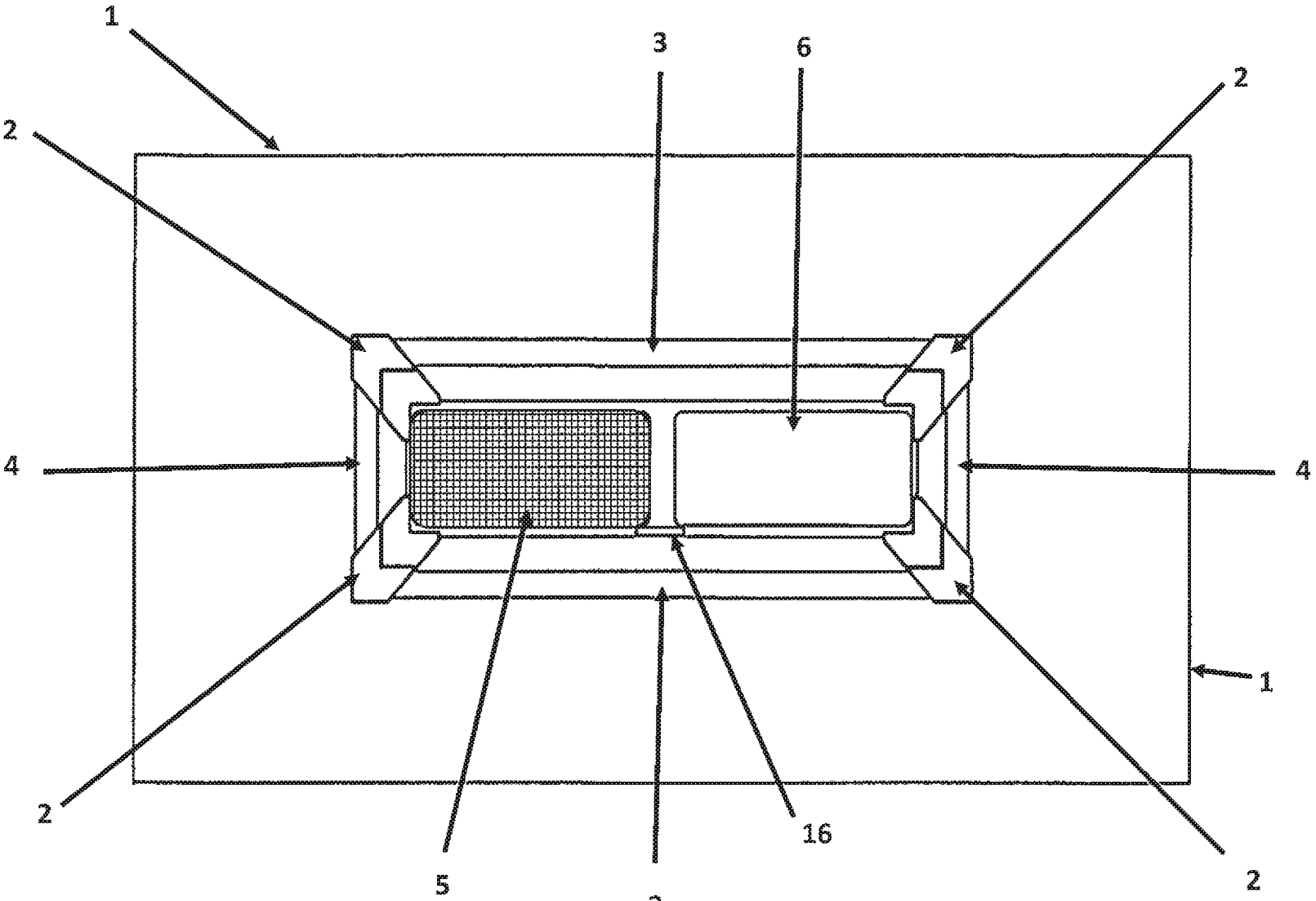
FIG. 2 is another front (exterior views), similar to that in FIG. 1, but in this figure the precut garage window dimensions are slightly larger than in FIG. 1.

FIG. 2 is another front view of a garage door panel, and is similar to FIG. 1 but in this figure the precut garage window dimensions are slightly larger than in FIG. 1. FIG. 2 shows all the parts in relationship to one another which are the same as FIG. 1 but in the adjusted expanded position.

Figure 3:
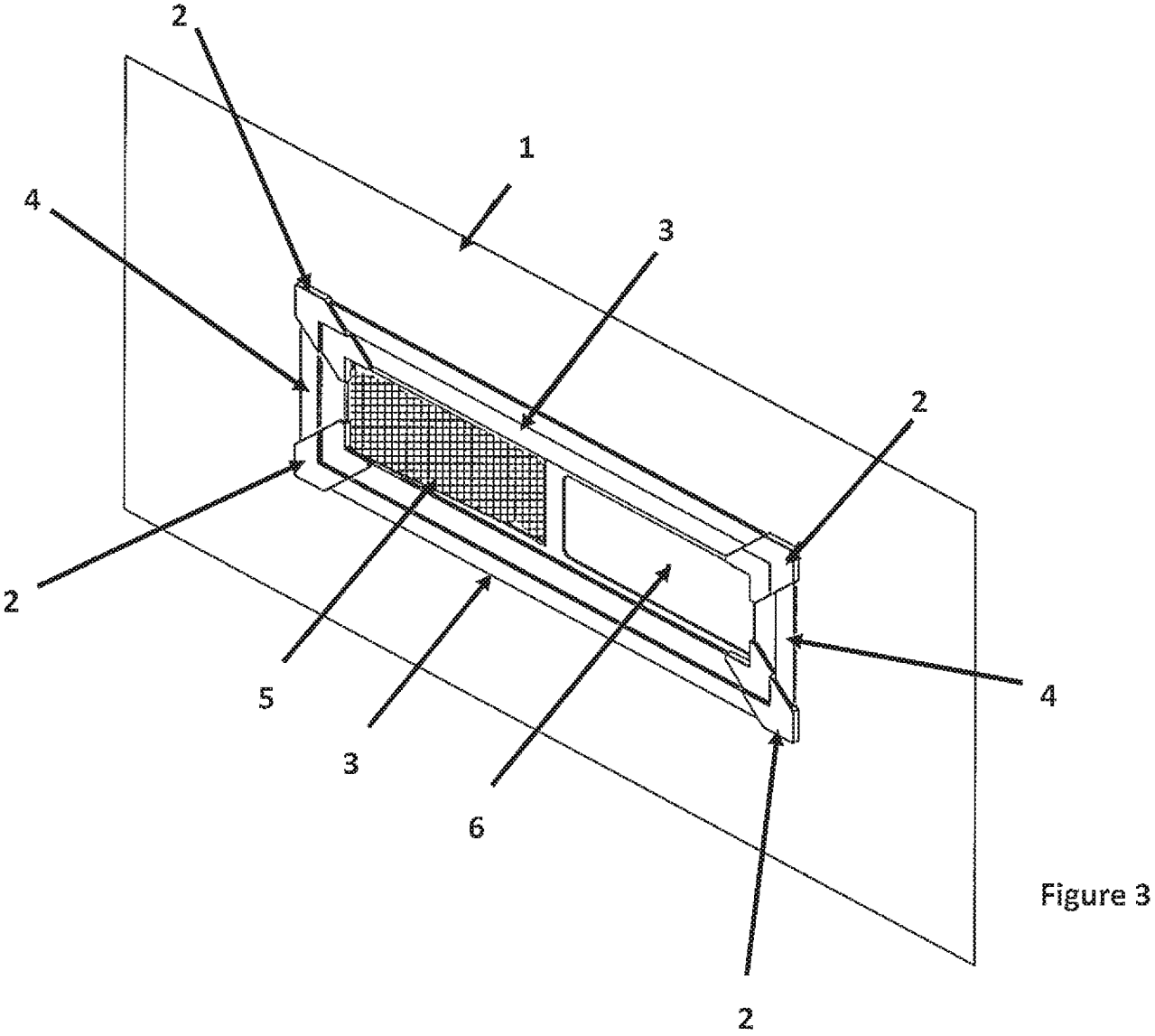
FIG. 3 is front, perspective view of the exterior of a garage door panel with the invention installed.

FIG. 3 is a perspective view, showing how all the components of the system fit together. It is important to note that in these FIGS. 1-3 it is shown how the Horizontal Exterior Frame Trims and Vertical Exterior Frame Trims are positioned behind the Exterior Corner Braces such that each Exterior Corner Brace covers an end of a Horizontal Exterior Frame Trim and an end of a Vertical Exterior Frame Trim.

Figure 4:
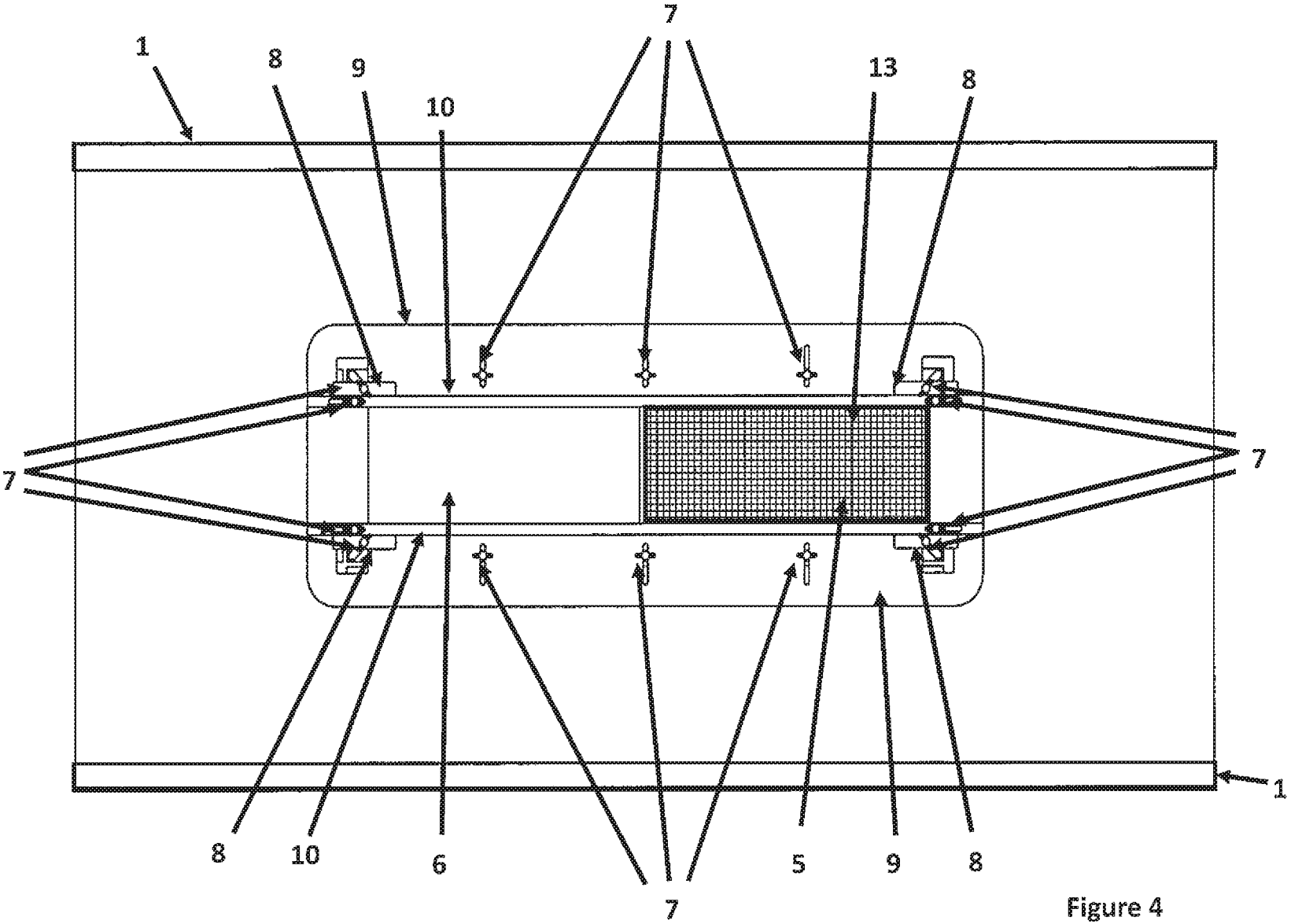
FIG. 4 is a back (interior) view of a garage door panel with the invention-design inserted.

FIG. 4 is a back (interior) view of a garage door panel with the invention-design inserted. It shows the relationship of all the interior parts in regard to each other. The Interior Panel Insert, more fully described in FIG. 7, serves as the base against which the various components on the front side of the panel can move and adjust. Interior Wing Nuts 7 removably secure the Exterior Corner Braces, Horizontal Exterior Frame Trim and Vertical Exterior Frame Trim in a preferred arrangement depending on the size of the hole in the panel. Corner Internal Securing Braces 8 can clamp down to maintain a certain configuration. In the Window Guide Rails 10, an insert 13, which can be made of clear glass, plexiglass or other clear or opaque material can slide to open or close the opening covered by the Screen Insert 5.

Figure 5:
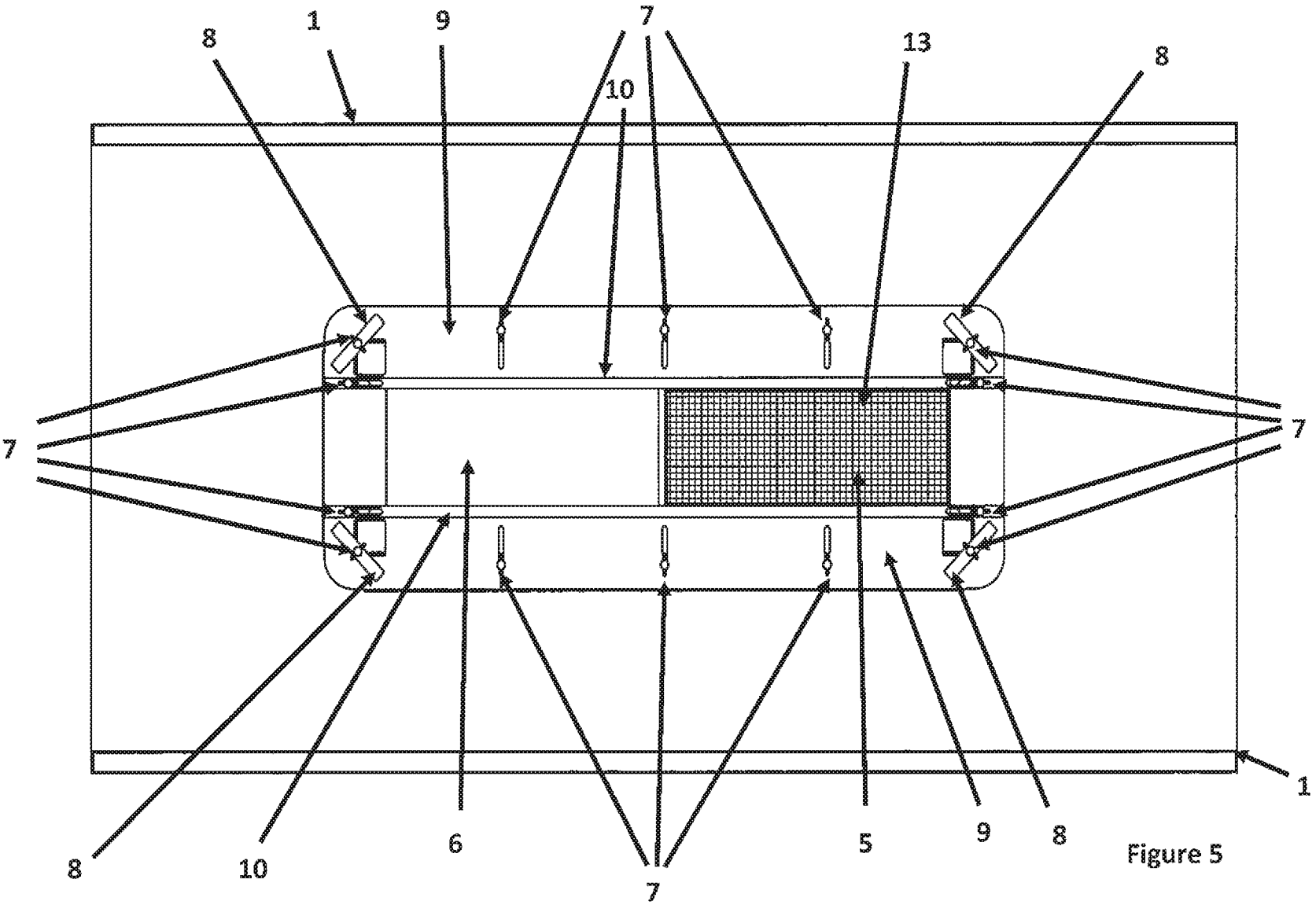
FIG. 5 is another back (interior) view, similar to that in FIG. 4, but in this figure the precut garage window dimensions are slightly larger than in FIG. 4.

FIG. 5 is back view, similar to FIG. 4, but in this figure the precut garage window dimensions are slightly larger than in FIG. 4. FIG. 5 shows all the parts in relationship to one another which are the same as in FIG. 4 but in the adjusted expanded position. This figure also shows the positioning of items #7 and #8 that are moved and secured against the interior panel #9 in different expanded positions than is shown in the previous FIG. 4.

Figure 6:
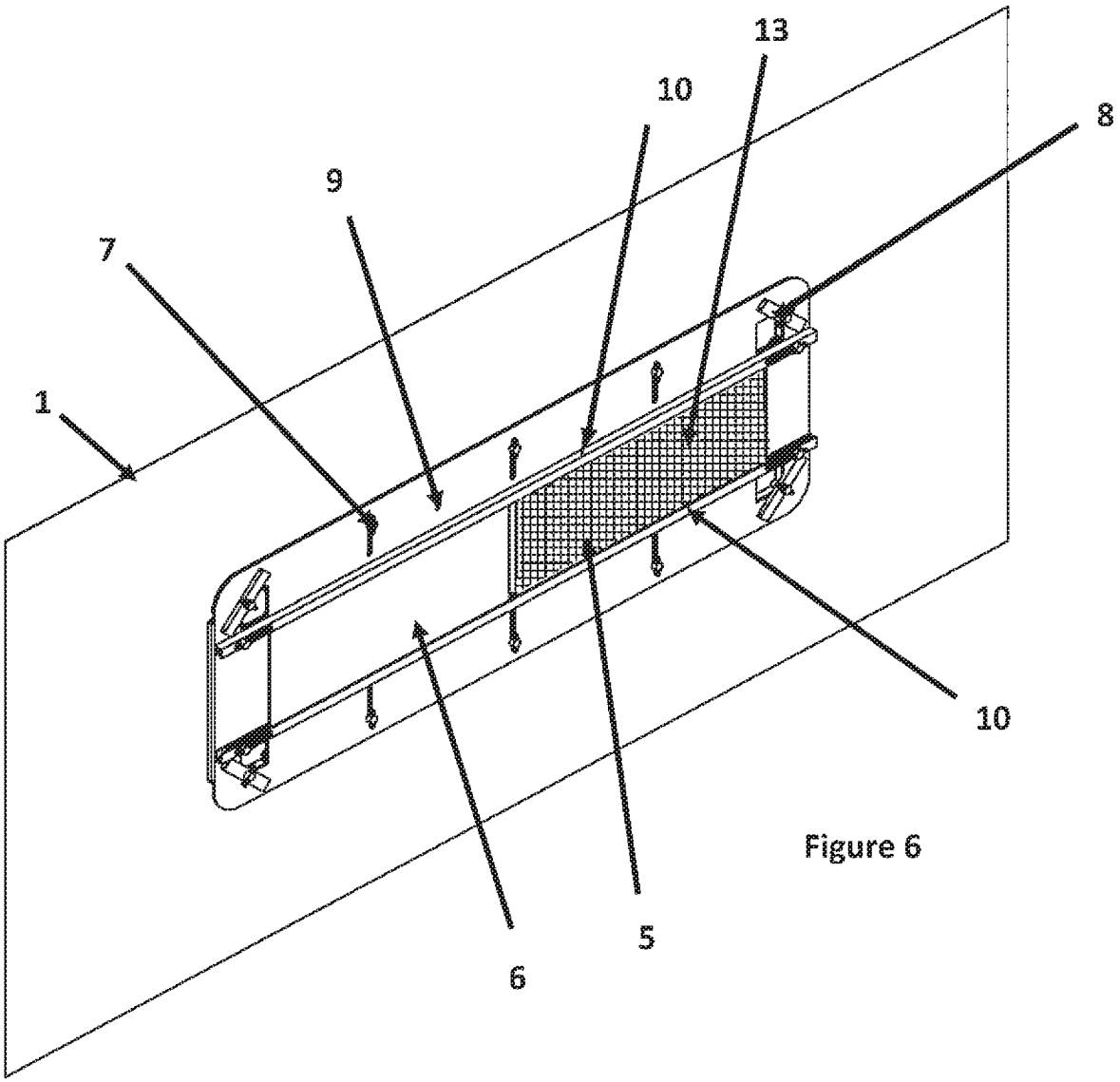
FIG. 6 is a back, perspective view of the invention installed in a garage door.

FIG. 6 is a back, perspective view, similar to FIGS. 4 & 5 but from a slightly different perspective.

Figure 7:
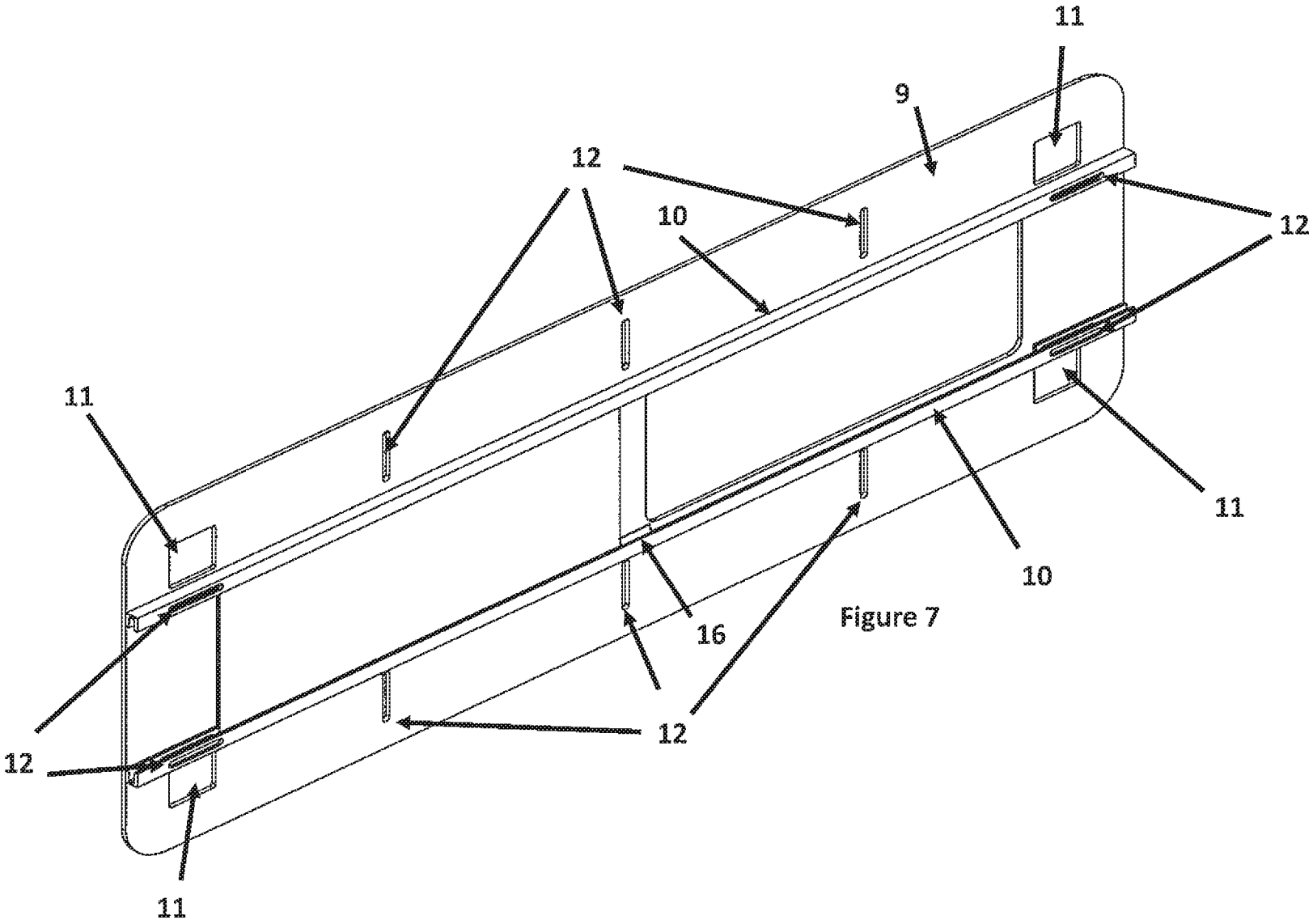
FIG. 7 is a perspective view of the Interior Panel Insert (#9) and its corresponding parts.

FIG. 7 depicts the Interior Panel Insert 9 and its corresponding parts. This Interior Panel Insert serves as the stationary foundation that most other parts adjust and are secured to. This insert is placed on the interior of the garage door panel and placed over the precut window area with a slight overlap onto the garage door panel. It is placed flush with the garage door panel separated by either a foam, rubber, plastic, or other type of seal. When the final desired adjusted size of the frame is accomplished this Panel Insert will be tightened, using the Interior Wing Nuts, sandwiching the garage door panel between this Panel and the Front Frames and Braces providing a tight and secure fit onto the garage door panel. The interior panel insert 9 has four #11*s* and a number of #12*s* which allow for the Exterior Corner Braces, Horizontal Exterior Frame Trims and Vertical Exterior Frame Trims to be adjusted outward and inward on the front of the panel. A Window Guide Rail 10 provides tracks upon which insert 6 can slide.

It is also shown in FIGS. 4 and 5 how the concept of this adjustable frame functions. As the precut garage door window size changes so does the relationship of positions of the other parts. In FIG. 4 all item parts are in their fixed positions. As the window size changes, as show in FIG. 5, the Interior Wing Nuts (#7) and the Interior Securing Brace (#8) are adjusted accordingly. As the window dimension gets larger the Interior Wing Nuts (#7) slide along the Wing Nut Adjustment Slots and/or Corner Trim Adjustment Space (see FIG. 7). This can be in either a horizontal (length wise) or vertical (height wise) direction. The corresponding Interior Securing Braces (#8) are also repositioned to lock the frame in place. As the repositioning of the Interior Wing Nuts and Securing Braces take place so does the repositioning of the Front (Exterior) Corner Trim Braces (#2). This repositioning of the exterior pieces is achieved by allowing the Interior Wing Nuts to be readjusted in the Corner Trim Adjustment Space (#11).

As mentioned and shown above in FIGS. 1-3, the Front Frame Trim is positioned behind the Front Corner Braces. In the inventions smallest adjustable size, the Front Frame Trim fits abutted snuggly against the Front Corner Braces. As the corner Interior Wing Nuts are adjusted in the Trim Adjustment Space (#11) the Exterior Corner Trim Braces are adjusted proportionately. This repositioning of the Corner Braces creates a slight gap between the Exterior Corner Braces themselves and the Exterior Frame Trim allowing the invention to be adjusted to a larger size window. By design, however, the Front Corner Braces are constructed large enough to cover this gap created between the Braces and Trim, as well as covering the open area of the Corner Trim Adjustment Space, thus giving the front, exterior, visual appearance of all parts fitting snuggly together with no apparent gap or widening between them.

As is the case, in order to achieve the correct window size adjustment and fit into the precut garage door window space, when the Front Corner Braces are adjusted so to may the Front Horizontal and/or Vertical Frame Trim. This is achieved by moving the corresponding Frame Trim to its desired position and then tightened down using the corresponding Interior Wing Nuts along their respective Wing Nut Adjustment Slots. The Horizontal and Vertical Frame Trim will have corresponding threaded holes, on their interior side, permitting the wing nuts to securely tighten them against the garage door panel. As already mentioned, the garage door panel would be tightened between the Interior Panel Insert and the Exterior Frame Trim and Braces. It is also noted that, as the Corner Braces are moved, the Horizontal and Vertical Frame Trim stays in basically their same positions relative to the Interior Panel Insert (#9) only being adjusted in relation to the Interior Wing Nuts Adjustment Slots (#12).

In addition to functioning as the stationary foundation for the adjustment aspects of this invention the Interior Panel Insert (#9) also has additional features. It also functions as the foundation that the holds the Stationary Clear Glass/Plexiglas Insert (#6) and the Screen Insert (#5). In addition, it has the Window Guide Rail (#10). These Guide Rails permit the Sliding Window Insert (#13) to be slid left or right to an opened or closed position. In the closed position, the Sliding Window Insert will be positioned on the interior side of the screen Insert. In the opened position, the Sliding Window Insert would be positioned on the interior side of the Glass/Plexiglas Insert.

It is noted that the both the Window inserts (#6 & #13) and the Screen Insert (#5) remain a fixed size. In the inventions smallest adjusted size the Front Corner Trim Braces and the Front Frame Trim will cover a portion of the windows and screen. As the adjustment in size becomes larger the newly adjusted positions of the Front Frames and Braces will allow for an expanded view of the window and screen thus allowing for additional light and ventilation (See FIGS. 1 & 2).

Figure 8:
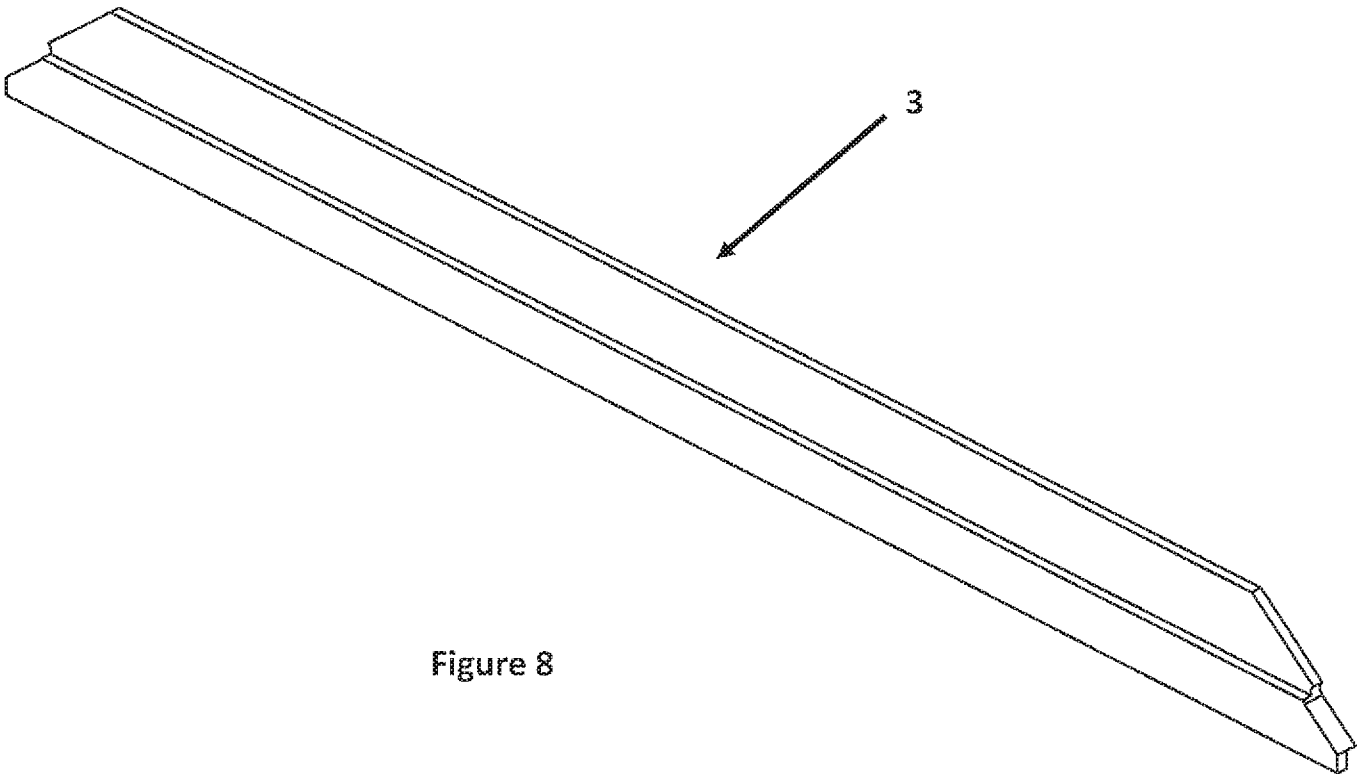
FIG. 8 is a perspective view of the Horizontal Exterior Frame Trim (Front view), including the threaded wing nut ports.

FIG. 8 is a front view of the Horizontal Exterior Frame Trim (Front view). This trim will be manufactured with threaded holes on the back side of the frame trim to allow the repositioning and tightening of the trim with the corresponding Wing Nuts.

Figure 9:
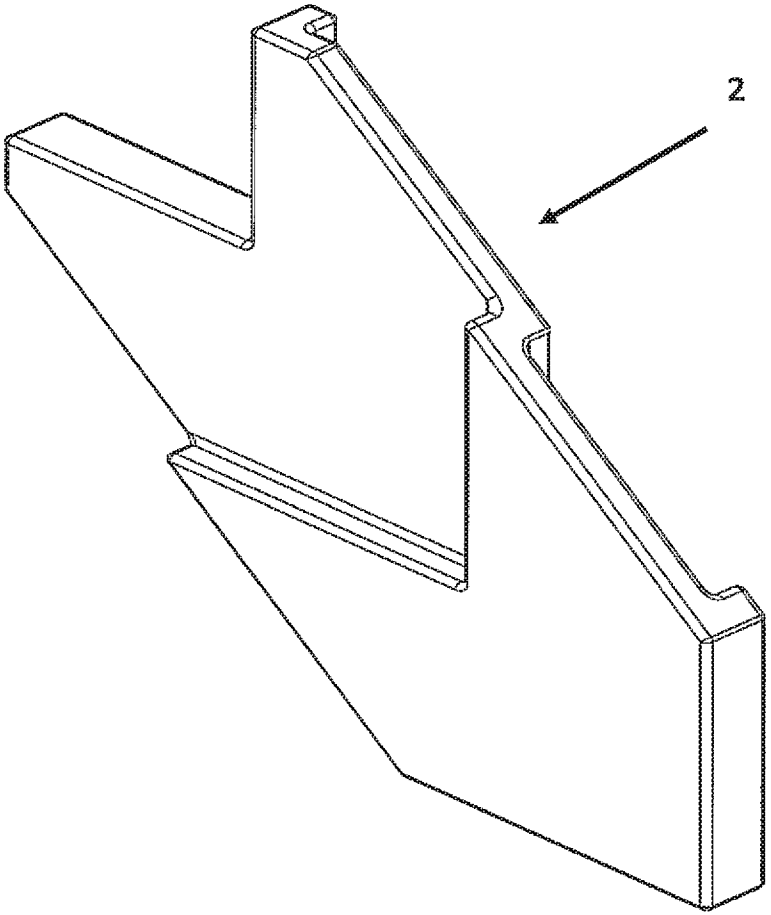
FIG. 9 is a perspective view of the #2 Exterior (Front) Corner Trim Brace, including the threaded wing nut ports.

FIG. 9 is a front view of the #2 Exterior (Front) Corner Trim Brace. This brace will be manufactured with threaded holes on the back side of the brace to allow the repositioning and tightening of the brace with the corresponding Wing Nuts. It should be noted that the #2 has a step in it, that mates with corresponding steps in the Horizontal Exterior Frame Trim and the #4 Vertical Exterior Frame Trim.

Figure 10:
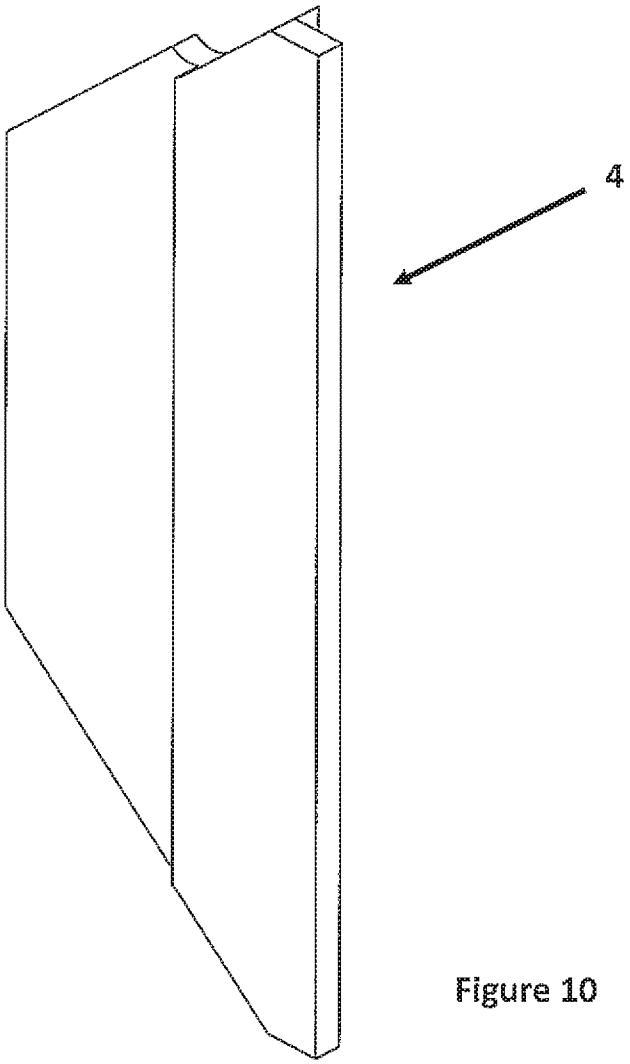
FIG. 10 is a perspective view of the #4 Vertical Exterior (Front) Frame Trim, including the threaded wing nut ports.

FIG. 10 is a front view of the #4 Vertical Exterior (Front) Frame Trim. This trim will be manufactured with threaded holes on the back side of the frame trim to allow the repositioning and tightening of the trim with the corresponding Wing Nuts.

Figure 11:
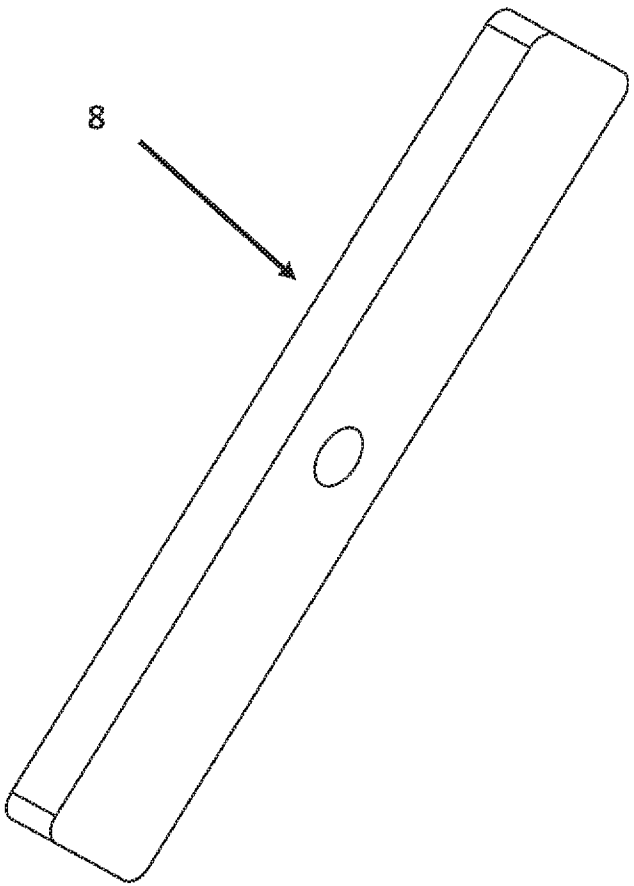
FIG. 11 is a perspective view of the #7 Wing Nut and the #8 Interior Corner Securing Brace.
Figure 11:
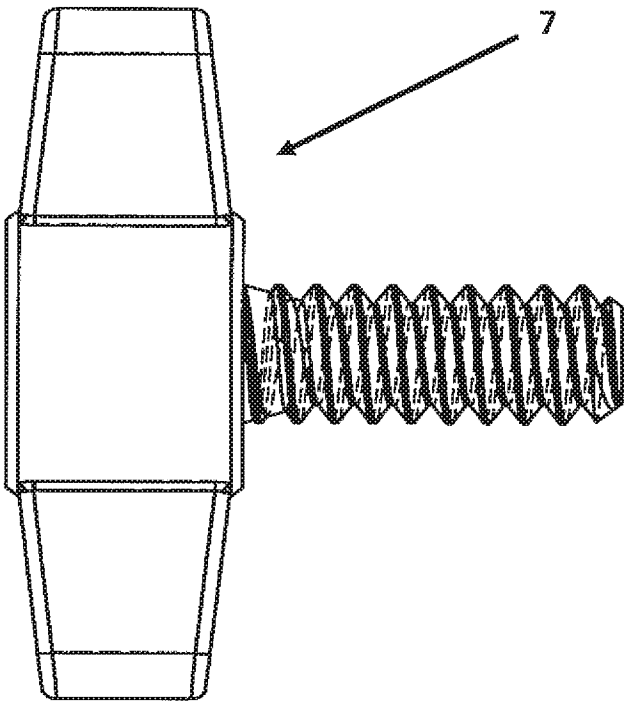

FIG. 11 shows an example of the #7 Wing Nut and the #8 Interior Corner Securing Brace.

Figure 12:
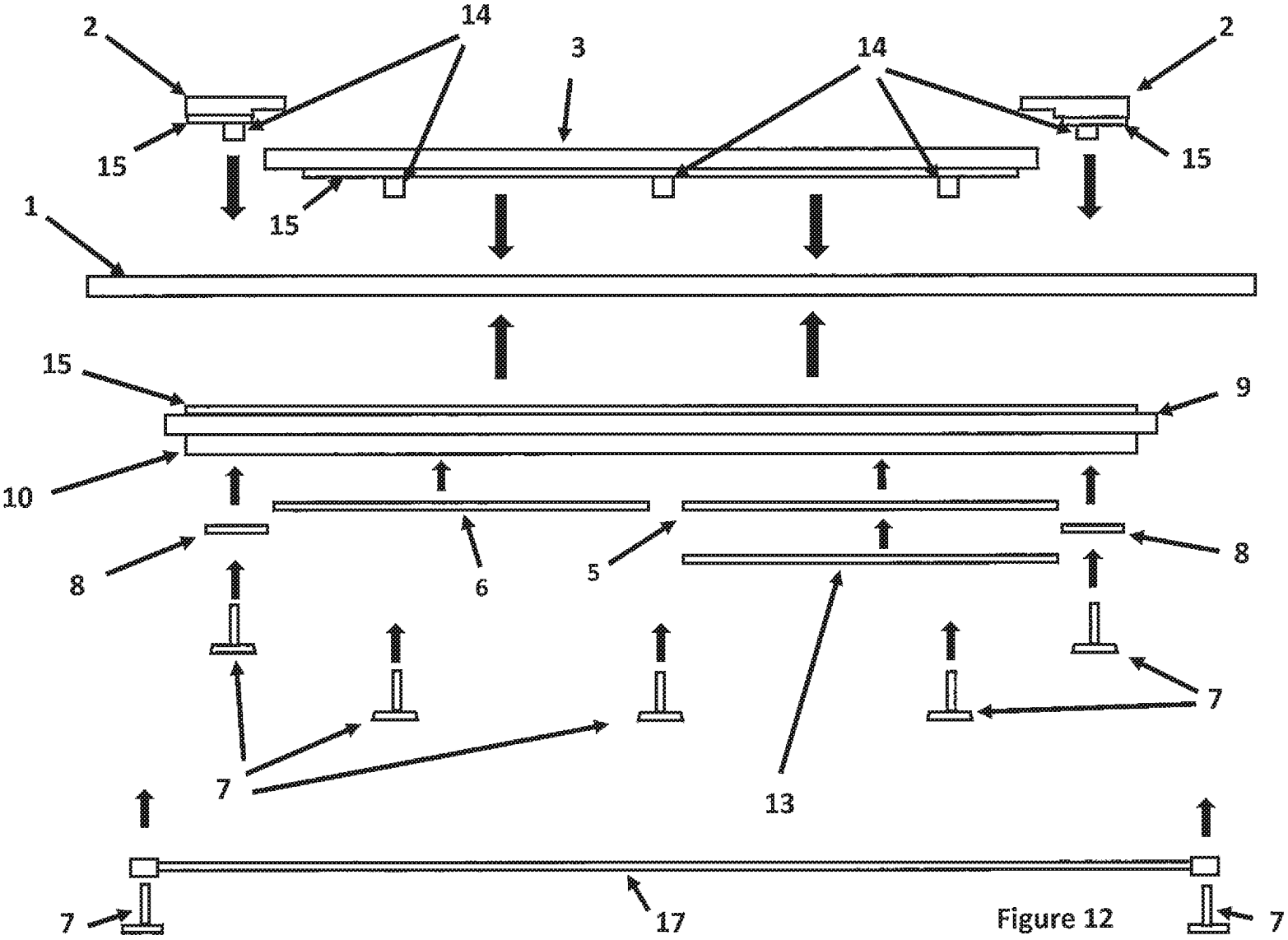
FIG. 12 is a top, exploded view of the invention.

FIG. 12 is a top, exploded view of the invention. As this is a top view, it cannot be seen, but there is a rectangular hole in garage door panel 1. The two halves of the invention—an internal section and an external section—are attached to each other through this rectangular opening. Making up the exterior portion, the horizontal exterior trim 3 has inward facing wingnut securing ports 14. In other figures it can been seen that the rectangular opening is bounded on the top and bottom by two horizontal exterior trims 3, and on the side by two vertical exterior trims (reference number 4 in FIG. 13). There are four exterior corner braces 2 that also have wingnut securing ports 14. A thin layer of insulation 15 prevents drafts, insects and dirt from getting into the garage door panel 1, and even into the garage. Making up the internal portion is an interior panel insert 9, also bounded by a layer of insulation 15 between the interior panel insert and the garage door panel 1. On the inside surface of the interior panel insert 9 is a window rail guide 10. There are actually two of these on either side of the rectangular opening, upon which the sliding clear glass/plexiglass insert 13 slides. Also attached to the window rail guides are a screen insert 5 and a stationary clear glass/plexiglass insert 6. The sliding insert 13 can move from an open position, where it overlays the stationary insert 6, to a closed position where is overlays the screen insert 5. The parts are held together by interior panel inserts 8, with wingnuts 7 extending through the various interior parts and being screwed into the wingnut securing receptacles 14 of the exterior portion of the invention.

Figure 13:
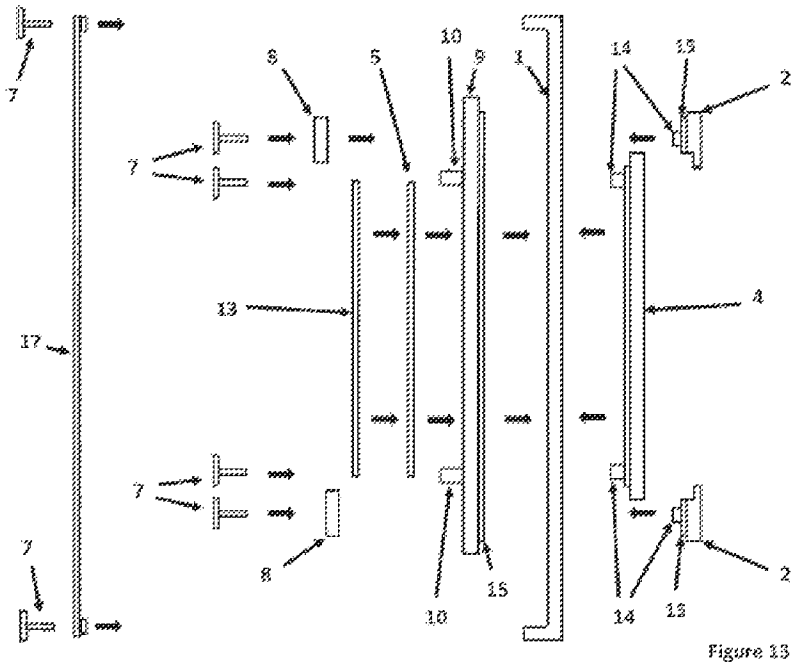
FIG. 13 is a side, exploded view of the invention.

FIG. 13 is a side, exploded view of the invention. The function of the parts are the same as with FIG. 12, but this gives a side view of the invention and shows how it is assembled. This figure, because it is a side view, shows the exterior vertical trim 4. As mentioned previously, the rectangular opening is bounded on the top and bottom by two horizontal exterior trims (reference number 3 in FIG. 12), and on the side by two vertical exterior trims 4.

Figure 14:
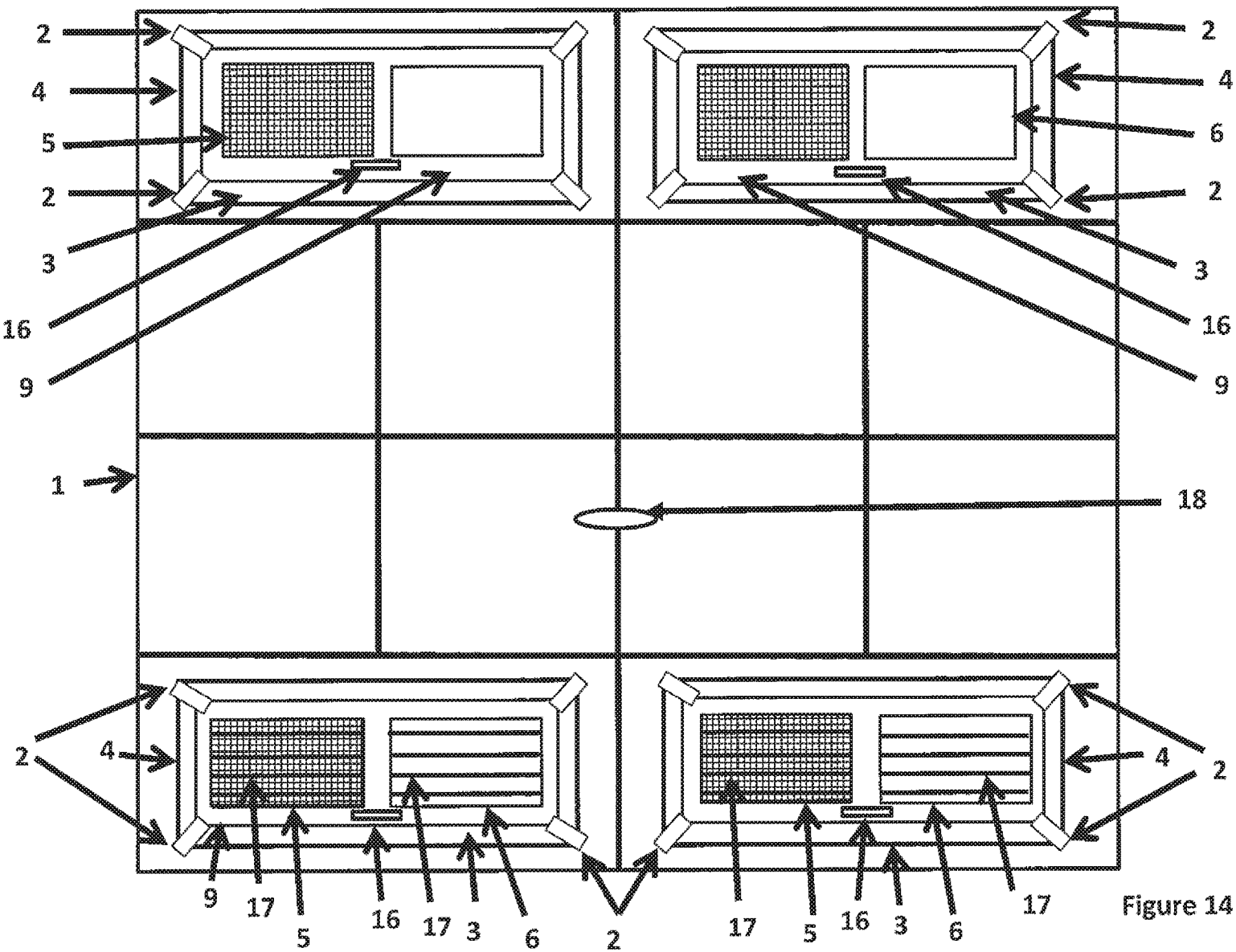
FIG. 14 is an exterior view of a garage door with four panels installed: two lower and two upper panels.

FIG. 14 is an exterior view of a garage door with four inserts 2 installed: two lower inserts in a lower garage door panel and two upper inserts installed in an upper garage door panel. In each panel, a hole has been moulded or cut into the panel, and the invention fits into this hole. The invention is bounded by various trims that are covered with corner braces. Here, there are Horizontal Exterior Frame Trim 3 and Vertical Exterior Frame Trim 4, the ends of which are covered by Exterior Corner Braces 2. This unique arrangement allows for the invention to expand and contract, depending on the size of the hole, and yet have the ends of the Horizontal 3 and Vertical 4 Exterior Frame Trim covered in an attractive (and functional) manner. Inside the area bounded by the Exterior Corner Braces and Horizontal Exterior Frame Trim sits a Screen Insert and a solid Clear Insert 6. The Screen Insert is what allows for ventilation, and the Clear Insert allows for light to penetrate the garage. Weep holes 16 at the bottom allow for rain to wash out to prevent water from leaking into the interior of the garage door panels. In the lower panels, security bars 17 prevent pets from escaping and burglars from trying to enter the garage.

Figure 15:
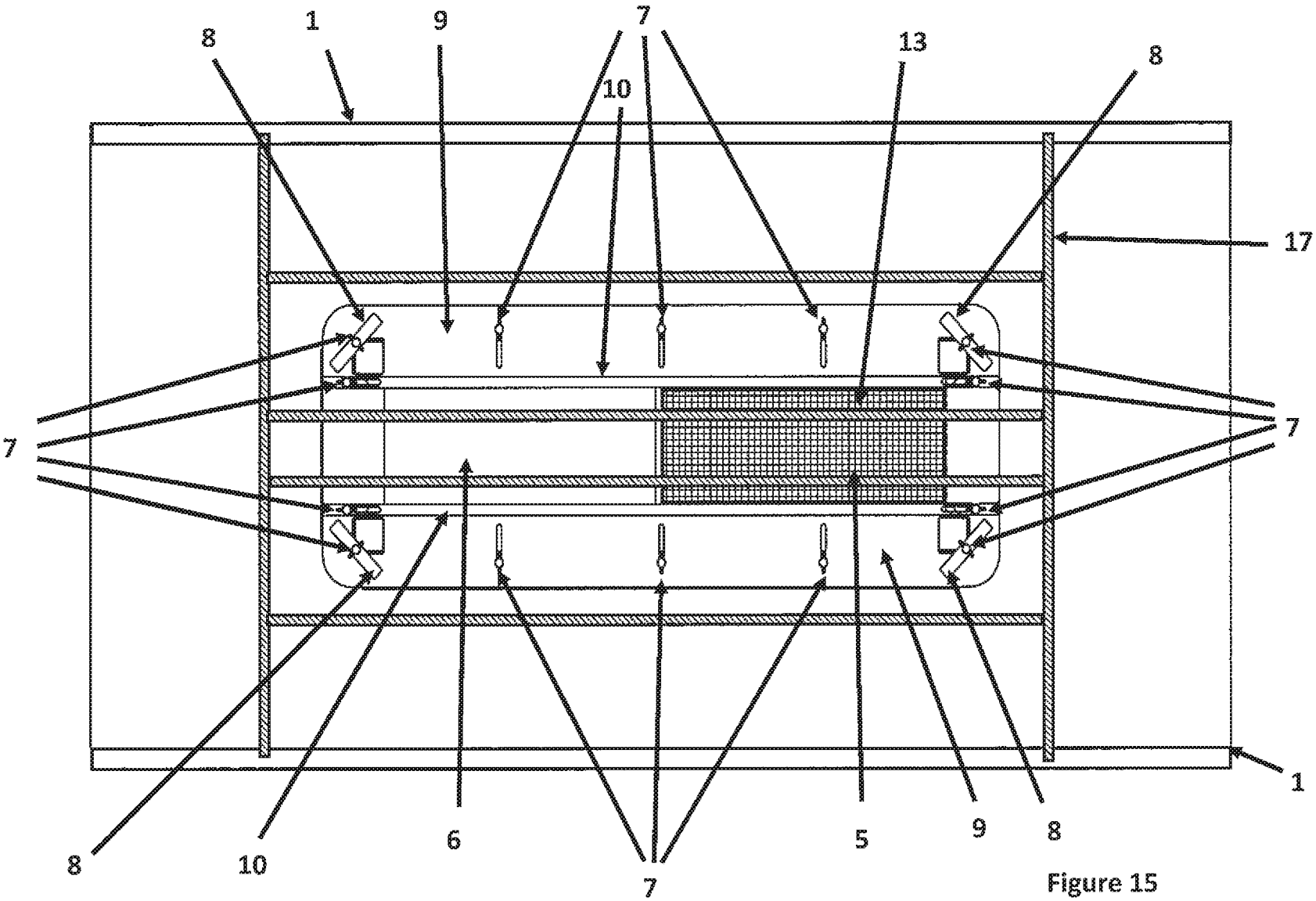
FIG. 15 is back view of a panel showing how the various components work together.

FIG. 15 is back view of a panel showing how the various components work together. The Interior Panel Insert, previously illustrated in FIG. 7, serves as the base against which the various components on the front side of the panel can move and adjust. Interior Wing Nuts 7 removably secure the Exterior Corner Braces, Horizontal Exterior Frame Trim and Vertical Exterior Frame Trim in a preferred arrangement depending on the size of the hole in the panel. Corner Internal Securing Braces 8 can clamp down to maintain a certain configuration. In the Window Guide Rails 10, an insert 13, which can be made of clear glass, plexiglass or other clear or opaque material can slide to open or close the opening covered by the Screen Insert 5. Security bars 17, in this case a security bar panel laid over the inside of the panel, prevents pets from escaping and burglars from entering the garage.

Figure 16:
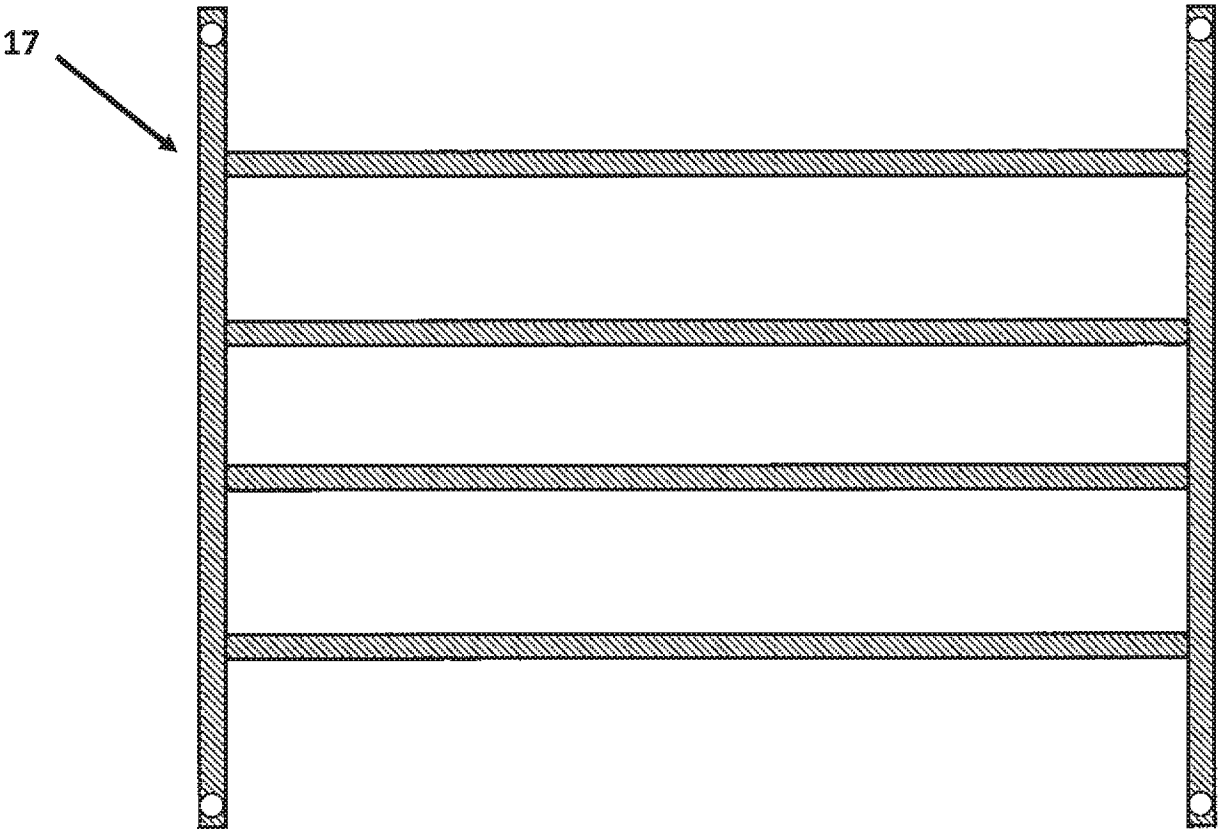
FIG. 16 is a front view of a set of bars.

FIG. 16 is a front view of a set of bars. It should be noted that the bars can be horizontal or vertical.

It is noted that this invention allows for this one adjustable frame insert to be adjusted in size to up to 3 inches in length and/or up to 3 inches in height thus fitting a large portion of the different garage door window sizes. In order to accommodate a different range of window sizes, this invention can be manufactured in various dimensions similar to a small, medium, and large size which is common to other products.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

REFERENCE NUMBERS USED

#1 Garage Door Panel
#2 Exterior (Front) Corner Trim Brace
#3 Horizontal Exterior (Front) Frame Trim
#4 Vertical Exterior (Front) Frame Trim
#5 Screen Insert
#6 Stationary Clear Glass/Plexiglas Insert
#7 Interior Wing Nuts
#8 Corner Interior Securing Brace
#9 Interior (Back) Panel Insert
#10 Window Guide Rail
#11 Exterior (Front) Corner Trim Adjustment Space
#12 Wing Nut Adjustment Slot
#13 Sliding Clear Glass/Plexiglas Insert
#14 Wing Nut Securing Ports
#15 Insulation Strip
#16 Weep Holes
#17 Security Bars
#18 Exterior Garage Door Handle That which is claimed:

1. A window for a garage door panel, consisting of: an internal section and an external section, where the external section comprises two horizontal external frame trims and two vertical external frame trims, where each horizontal external frame trim has a horizontal step, and two horizontal ends, and each vertical external frame trim has a vertical step and two vertical ends, where each horizontal end and each vertical end intersect at a 90 degree angle, where the two horizontal external frame trims and the two vertical frame trims form a rectangular opening, additionally comprising four exterior corner braces, where each exterior corner brace has a corner step, where each exterior corner brace constrains and coversone horizontal end and one vertical end, where the corner step mates with the horizontal step, and where the corner step mates with the vertical step, such that the four corner braces move in an inward direction and an outward direction to cause the two horizontal frame trims and the two vertical frame trims to move an inward direction inside the four exterior corner braces to decrease the rectangular opening, and such that the two horizontal frame trims and the two vertical frame trims can be pushed in an outward directions inside the four exterior corner braces to increase the rectangular opening, additionally comprising an interior back panel insert, where the interior back panel insert is connected to the two horizontal frame trims, the two vertical frame trims, and the four corner braces by a plurality of wingnuts, where the interior back panel insert has a plurality of elongated slits, where the plurality of wingnuts extend from an inner side of the plurality of wingnut adjustment slots to a plurality of wingnut receptacles in the two horizontal exterior frame trims and a plurality of bolt receptacles in the two vertical exterior frame trims, and to a plurality of corner interior securing braces such that as each of the two horizontal exterior frame trims and each of the two vertical exterior frame trims move, the plurality of wingnuts can be tightened to secure each of the two horizontal exterior frame trims and each of the two vertical exterior frame trims in a new position, where the interior back panel insert additionally comprises four exterior corner trim adjustment spaces, where, as an exterior corner brace is moved on the external section, it can be secured at a new location with an interior wingnut, where the interior back panel insert additionally comprises two window guide rails, where there is an upper window guide rail and a lower window guide rail, where a screen insert is secured between the upper window guide rail and the lower window guide rail at a first end, and where a clear insert is secured at a second end, and a sliding insert, where the sliding insert can be slid within the two window guide rails, such that it can create a closed position, where the sliding insert is located in front of the screen insert, and an open position, where the sliding insert is located in front of the clear insert, where, each of the exterior corner trim braces and each of the horizontal trim braces contain at least one wingnut securing port.

2. The window of claim 1, additionally comprising one or more layers of insulation, with the one or more layers of insulation is located between an inner face of the interior frame and an interior face of the exterior frame.

3. The window of claim 2, where the exterior frame additionally comprises one or more weep holes.

4. The window of claim 3, where the screw port threaded portion contains at least one wingnut securing port.

5. The window of claim 4, additionally comprising one or more security bars.

6. The window of claim 5, additionally comprising a stationary panel and the sliding panel, where the stationary panel and the sliding panel are contained within the opening, additionally comprising a screen guide rail, where the sliding panel slides within the screen guide rail, where the sliding panel can be moved in a lateral direction across the body.

7. The window of claim 6, where the opening additionally comprises one or more security bars.

8. The window of claim 7, where the exterior frame additionally comprises one or more weep holes, and, where the screw port threaded portion contains at least one wingnut securing port.

9. A window for a garage door panel, comprising: a body, an opening, and an attachment device which attaches the body to a panel of a garage door, where the opening is located in the body, and bounded on all sides by the body, where the body comprises an exterior frame and an interior frame, where the interior frame comprises one or more screw holes, and where the exterior frame comprises one or more screw ports, where one or more screws, each with a screw head and a threaded portion, attach the interior frame to the exterior frame as the screw head rests on an outside face of the interior frame and the threaded portion mates with a screw port threaded portion, where the exterior frame comprises four exterior members and four exterior corner braces, where each of the four exterior corner braces joins two of the four exterior members at a 90 degree angle, and where the interior frame comprises two or more interior members and four or fewer interior corner braces, where each of the four or fewer interior corner braces joins two of the four interior members at a 90 degree angle, such that the interior frame and the exterior frame are tightened against each to clasp four edges of a cavity in a garage door panel, where the screw port threaded portion contains at least one wingnut securing port.

10. The window of claim 9, additionally comprising a sliding door cover, where the sliding door cover can be moved in a lateral direction across the body to cover and uncover the opening.

11. The window of claim 10, where the opening additionally comprises one or more security bars.

12. The window of claim 11, additionally comprising one or more layers of insulation, where the one or more layers of insulation is located between an inner face of the interior frame and an interior face of the exterior frame.

13. The window of claim 12, where the exterior frame additionally comprises one or more weep holes.

14. The window of claim 9, additionally comprising a stationary panel and a sliding panel, where the stationary panel and the sliding panel are contained within the opening, additionally comprising a screen guide rail, where the sliding panel slides within the screen guide rail, where the sliding panel can be moved in a lateral direction across the body.

15. The window of claim 14, where the exterior frame additionally comprises one or more weep holes.

16. The window of claim 15, additionally comprising one or more security bars.

17. The window of claim 16, additionally comprising a sliding door cover, where the sliding door cover can be moved in a lateral direction across the body to cover and uncover the opening.

18. The window of claim 17, additionally comprising one or more layers of insulation, with the one or more layers of insulation is located between the inner face of the interior frame and the interior face of the exterior frame and additionally comprising the stationary panel and the sliding panel, where the stationary panel and the sliding panel are contained within the opening, additionally comprising the screen guide rail, where the sliding panel slides within the screen guide rail, where the sliding panel can be moved in a lateral direction across the body, where the exterior frame additionally comprises one or more weep holes.

19. The window of claim 18, where the screw port threaded portion contains at least one wingnut securing port.

* * * * *